US005982283A

United States Patent [19]

Matsudaira et al.

[11] Patent Number: 5,982,283

[45] Date of Patent: Nov. 9, 1999

[54] ANTITHEFT SYSTEM

[75] Inventors: Shinji Matsudaira, Higashiosaka; Hitoshi Kihara, Sanda, both of Japan

[73] Assignees: Sanyo Electric Co., Ltd.; Sanyo Electronics Components Co., Ltd., both of Osaka, Japan

[21] Appl. No.: 09/140,418

[22] Filed: Aug. 26, 1998

[30] Foreign Application Priority Data

Sep. 1, 1997 [JP] Japan ..... 9-236196

[51] Int. Cl.[6] ..... G08B 13/22

[52] U.S. Cl. ..... 340/572.3; 340/309.15; 340/527; 340/571; 340/572.1

[58] Field of Search ..... 340/572.3, 572.1, 340/571, 527, 309.15

[56] References Cited

U.S. PATENT DOCUMENTS 5,764,147 6/1998 Sasagawa et al. ..... 340/572.1
5,808,548 9/1998 Sasagawa et al. ..... 340/571

*Primary Examiner*—Glen Swann
*Attorney, Agent, or Firm*—Nikaido, Marmelstein, Murray & Oram LLP

[57] ABSTRACT

A nullification device of the invention comprises a nullifying signal generator 15 for producing a nullifying signal, and a controller 14 for measuring a predetermined period of time and on/off-controlling a mode change switch 16 provided between the signal generator 15 and a transmitting antenna 18. On the other hand, an activation device comprises a generator 23 for producing an activating signal for the nullification device. The activation device and the nullification device have connection terminals a, b and a', b', respectively, where the devices are in contact with each other, with the nullification device placed in a accommodating recess in the activation device. The controller 14 turns on the switch 16 in response to the activating signal, starts to measure time upon cessation of supply of the activating signal, and turns off the switch 16 upon lapse of the specified time period, whereby the nullification device for forcibly ceasing the generation of an alarm by an alarm unit is prevented from being used wrongfully.

9 Claims, 14 Drawing Sheets

ANTITHEFT SYSTEM

FIELD OF THE INVENTION

The present invention relates to antitheft systems for protecting commodities on display in stores from unlawful acts such as shoplifting, and more particularly to antitheft systems comprising a nullification device which is adapted to forcibly stop the generation of an alarm by an alarm unit.

BACKGROUND OF THE INVENTION

FIG. 15 shows an antitheft system conventionally used in stores wherein commodities such as compact disk cassettes and magnetic tape cassettes are on display for sale, to protect these articles from shoplifting or like illegal acts.

The antitheft system comprises an antitheft gate 4 installed in the vicinity of an exit 40 of the store, and an alarm unit 3 attached to a commodity 5. The antitheft gate 4 has a circuit board 41 and a transmitting antenna (not shown). The circuit board 41 is provided with a transmitting circuit (not shown) for producing an alarm activating signal for the alarm unit 3.

With reference to FIG. 16, the alarm unit 3 comprises a buzzer 31, circuit board 33, battery (not shown), etc. which are housed in a casing 30. The casing 30 has a surface formed with sound emitting holes 34 and an alarm actuating switch piece 32. The buzzer 31 has its operation controlled by the circuit board 33 and is adapted to produce an alarm when the unit 3 is removed from the commodity or when the unit 3 passes by the antitheft gate 4.

The commodity is placed on display in the store, with the alarm unit 3 attached thereto. When selling the commodity to the customer, the clerk holds the buzzer 31 out of operation by sending a specified signal from a nullification device (not shown) to the circuit board 33 of the alarm unit 3, then removes the unit 3 from the commodity and hands the commodity to the customer in exchange for money.

If the customer wrongfully removes the alarm unit 3 from the commodity 5, the switch piece 32 is turned off to actuate the buzzer 31. Further if the customer acts to unlawfully bring the commodity 5 out of the store along with the alarm unit 3, the circuit board 33 of the alarm unit 3 receives an alarm activating signal from the transmitting antenna of the antitheft gate 4 to turn on the buzzer 31.

However, the antitheft system described has the following problem. It is likely that a customer or clerk temporarily employed will steal the nullification device from the store. The person stealing the nullification device can use the device unlawfully in other store to bring an alarm unit 3 out of alarming operation and then remove the alarm unit 3 from the commodity attached thereto, so that the commodity can be readily brought out of the store.

SUMMARY OF THE INVENTION

An object of the present invention is to provide an antitheft system comprising a nullification device which can be prevented from being used wrongfully.

The present invention provides an antitheft system comprising an alarm unit to be connected to an article to be prevented from being stolen, and a nullification device for transmitting a nullifying signal to the alarm unit. The alarm unit comprises alarm means for producing an alarm, detecting means for detecting disconnection of the alarm unit from the article to produce a detection signal, and alarm control means for operating the alarm means upon receiving the detection signal and nullifying the detection signal after receiving the nullifying signal from the nullification device. On the other hand, the nullification device comprises:

- means for generating the nullifying signal at all times in an operative mode or generating the nullifying signal in response to the user's manipulation,
- activation commanding means for giving an activation command in response to the user's manipulation,
- means for producing a variable increasing with lapse of time or with the frequency of the user's manipulation for generating the nullifying signal,
- means for resetting the variable producing means in response to the user's manipulation, and
- nullification control means for setting the nullifying signal generating means in the operative mode in response to the activation command while setting the nullifying signal generating means in an inoperative mode upon the variable produced by the variable producing means exceeding a predetermined threshold value.

When the antitheft system is to be used, for example, in stores, the commodities to be prevented from being stolen are placed on display, with the alarm unit connected to each of the commodities.

When the commodity as removed from the display table is wrongfully disconnected from the alarm unit by a customer, the detecting means produces a detection signal, whereupon the alarm control means of the alarm unit operates the alarm means in response to the detection signal, thereby causing the alarm means to give an alarm and notifying the people in the neighborhood of the unlawful act.

On the other hand, the nullification device is held in the hand of the clerk at least while the store is open.

When the activation commanding means is manipulated by the clerk for giving an activation command, the commanding means issues the command in response to the manipulation, and the nullification control means sets the nullifying signal generating means in the operative mode in response to the activation command. This causes the signal generating means to generate a nullifying signal at all times, or this means generates a nullifying signal in response to a manipulation by the user.

Further when the clerk performs a manipulation for resetting the variably producing means, the resetting means resets the variable producing means to initialize the variable of the variable producing means to zero.

The customer hands the commodity and the alarm unit connected thereto to the clerk, who in turn sends the nullifying signal, to the alarm unit from the nullification device, whereupon the alarm control means, receiving the nullifying signal, nullifies the subsequent detection signal. As a result, the alarm unit is forced to cease emitting the alarm despite the input of the detection signal. With the alarm unit thus forcibly brought out of the alarm generating operation, the commodity is disconnected from the unit and handed to the customer by the clerk.

When the variable produced by the variable producing means has thereafter exceeded the predetermined threshold value, the nullification control means, detecting this, sets the nullifying signal generating means in the inoperative mode. In the case where the variable producing means produces a variable which increases with time, the threshold value predetermined is the period from the store opening time until the closing time, e.g., 8 hours. In this case, the nullifying signal generating means is set in the inoperative mode upon closing the store. Alternatively in the case where the variable producing means produces a variable which increases with the frequency of manipulation by the user for generating the nullifying signal, the predetermined threshold value is a value corresponding to the frequency of use of the nullification device. In this case, the nullifying signal generating means is set in the inoperative mode when the user has performed the manipulation for generating the nullifying signal a specified number of times.

When set in the inoperative mode as described above, the nullifying signal generating means stops generating the nullifying signal, or is forced to stop generating the signal in spite of the user's manipulation for generating the nullifying signal.

Accordingly, even if a customer or clerk temporarily employed should steal the nullification device in an attempt to use the device in other store, the device generates no nullifying signal and is no longer effectively serviceable.

More specifically, the invention provides a first antitheft system of the type described which further comprises an activation device for transmitting an activating signal to the nullification device, the activation device comprising means for preparing the activating signal, and means for transmitting to the nullification device the activating signal produced by the activating signal preparing means, the nullification device comprising receiving means capable of receiving the activating signal from the transmitting means of the activation device in response to a manipulation by the user, the activation commanding means being operable to give the activation command in response to the activating signal received from the receiving means, the resetting means being operable to reset the variable producing means when the activating signal is no longer received by the receiving means.

More specifically, the activation device and the nullification device are housed in separate casings respectively, the casing of the activation device being formed with a recessed portion for placing therein the casing of the nullification device, and the transmitting means of the activation device and the receiving means of the nullification device are opposed to each other for the receiving means to receive the activating signal from the transmitting means, with the casing of the nullification device placed in the recessed portion of the casing of the activation device.

With the first antitheft system, the activation device is accommodated, for example, in a safe within the store, and the nullification device is placed into the recessed portion of the activation device when the store is closed. The transmitting means of the activation device and the receiving means of the nullification device are opposed to each other in this state, such that the activating signal produced by the signal preparing means of the activation device is fed to the activation commanding means via the transmitting means and then via the receiving means. The activating commanding means issues an activation command upon receiving the activating signal. Receiving the activation command, the nullification control means sets the nullifying signal generating means in the operative mode. Consequently, this signal generating means generates a nullifying signal at all times. Alternatively, this means produces a nullifying signal in response to a manipulation by the user.

The clerk takes out the nullification device from the recessed portion of the activation device when opening the store, whereupon the receiving means no longer receives the activating signal. Detecting this, the resetting means resets the variable producing means.

When the variable produced by the variable producing means has subsequently exceeded the predetermined threshold value, the nullification control means detects this, setting the nullifying signal generating means in the inoperative mode. Consequently, the signal generating means ceases generating the nullifying signal, or is forced to stop generating the nullifying signal in spite of the user's manipulation for generating the nullifying signal.

More specifically stated, each of the transmitting means of the activation device and the receiving means of the nullification device comprises a plurality of terminals to be in contact respectively with those of the other.

When the nullification device is then placed into the recessed portion of the activation device, the terminals of the activation device come into contact with those of the nullification device. As a result, the activating signal produced by the signal preparing means of the activation device is fed to the activation commanding means through the terminals of the activation device and then through the terminals of the nullification device.

In an alternative specific construction, the transmitting means of the activation device and the receiving means of the nullification device respectively comprise a transmitter and a receiver for a magnetic signal or optical signal.

When the nullification device is then placed into the recessed portion of the activation device, the transmitter of the activation device is opposed to the receiver of the nullification device. As a result, a magnetic signal or optical signal produced by the signal preparing means of the activation device is emitted by the transmitter, input to the receiver and fed to the activation commanding means as the activating signal.

Stated specifically, the invention provides a second antitheft system of the type first described in which the nullification device comprises a data input means, and the activation commanding means of the nullification device gives the activation command while the resetting means resets the variable producing means when start data representing a specified code is input by the data input means.

With the second antitheft system, the nullification device is held in the hand of the clerk.

The clerk enters the start data representing the specified code by manipulating the data input means when opening the store, whereupon the activation commanding means issues an activation command. In response to the command, the nullification control means sets the nullifying signal generating means in the operative mode. As a result, the signal generating means produces a nullifying signal at all times, or produces a nullifying signal in response to a manipulating by the user. When the start data is input, the resetting means rests the variable producing means.

When the variable produced by the variable producing means has subsequently exceeded the predetermined threshold value, the nullification control means detects this, setting the nullifying signal generating means in the inoperative mode. Consequently, the signal generating means ceases generating the nullifying signal, or is forced to stop generating the nullifying signal in spite of the user's manipulation for generating the nullifying signal.

With the second antitheft system of the specific construction described, the nullification device comprises stop commanding means for giving a stopping command when a stop data representing a specified code is input by the data input means, and the nullification control means sets the nullifying signal generating means in the inoperative mode in response to the stopping command.

With this specific construction, the clerk enters the stop data by manipulating the data input means, whereupon the stop commanding means issues a stopping command. In response to the stopping command, the nullification control means sets the nullifying signal generating means in the inoperative mode. As a result, the signal generating means is forced to cease generating the nullifying signal regardless of the value of the variable given by the variable producing means.

Accordingly, the system is useful in the case where the service hours of the store are shortened by closing the store earlier.

In an alternative specific construction, the data input means comprises a key input device, and the start data can be input to the nullification device easily by manipulating keys.

Stated specifically, the invention provides a third antitheft system of the type described first, which comprises key means, and in which the activation commanding means of the nullification device gives the activation command while the resetting means resets the variable producing means in response to an on manipulation with use of the key means.

With the third antitheft system, the nullification device is held in the hand of the clerk.

The clerk performs an on manipulation with use of the key means when opening the store, whereupon the activation commanding means issues an activation command. In response to the command, the nullification control means sets the nullifying signal generating means in the operative mode. As a result, the signal generating means produces a nullifying signal at all times, or produces a nullifying signal in response to a manipulating by the user. Further when the on manipulation is performed with use of the key means, the resetting means resets the variable producing means.

When the variable given by the variable producing means has subsequently exceeded the predetermined threshold value, the nullification control means detects this, setting the nullifying signal generating means in the inoperative mode. Consequently, the signal generating means ceases generating the nullifying signal, or is forced to stop generating the nullifying signal in spite of the user's manipulation for generating the nullifying signal.

With the antitheft system, even if a customer or clerk temporarily employed should steal the nullification device from the store, the nullification device ceases generating the nullifying signal upon lapse of a predetermined period of time after the variable producing means has been reset or when the device has been used a predetermined number of times. The nullification device is therefore unusable in other store and prevented from being used wrongfully.

DETAILED DESCRIPTION OF EMBODIMENTS

Five embodiments of the invention will be described below in detail with reference to the drawings.

First Embodiment

Figure 15:
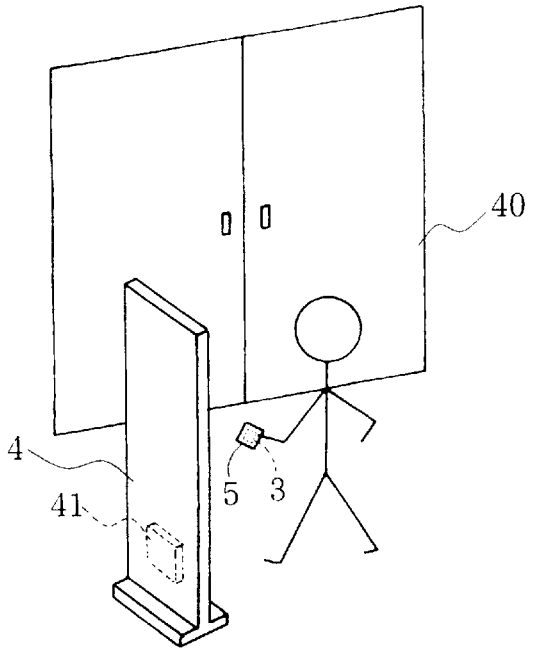
FIG. 15 PRIOR ART
FIG. 15 is a perspective view showing an antitheft gate installed in the vicinity of an exit of a store.
Figure 16:
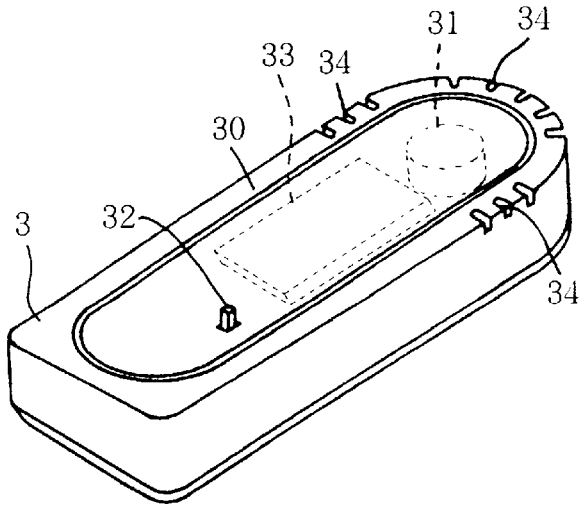
FIG. 16 PRIOR ART
FIG. 16 is a perspective view showing the appearance of an alarm unit.

The antitheft system according to this embodiment comprises an antitheft gate 4 and an alarm unit 3 which are the same as those of the prior art shown in FIGS. 15 and 16 in construction. The antitheft gate 4 is installed in the vicinity of an exit 40 of a store, and the alarm unit 3 is attached to a commodity 5 on display in the store.

The alarm unit 3 can be changed over from a set state to a reset state, and vice versa. In the set state, the unit 3 produces an alarm upon an alarm actuating switch piece 32 being turned off or on receiving an alarm activating signal from a transmitting antenna of the antitheft gate 4. In the reset state, the alarm unit 3 is forced to cease producing an alarm when the switch piece 32 is off or when the unit is receiving the alarm activating signal. The alarm unit 3 is changed over from the set state to the reset state by receiving a nullifying signal from the nullification device 1 to be described below.

Figure 1:
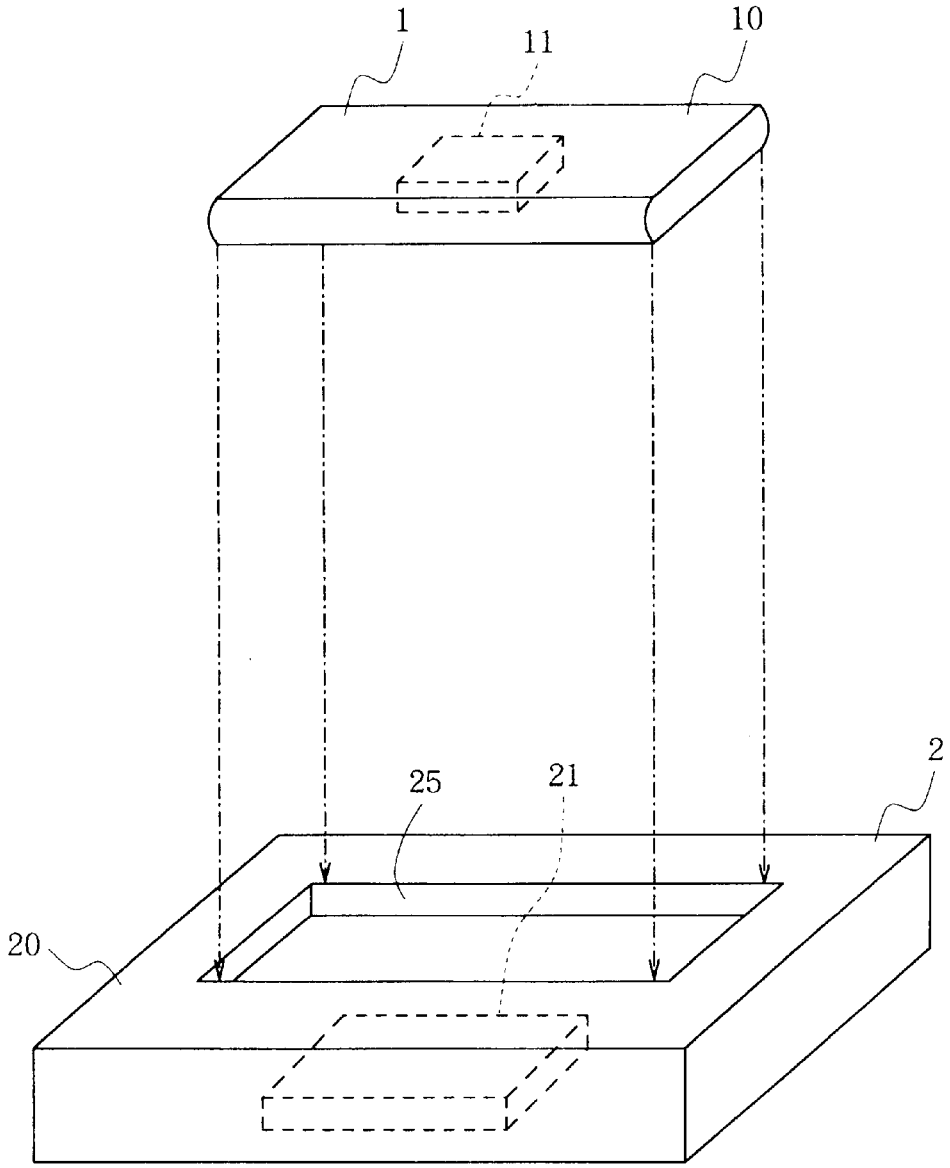
FIG. 1 is a perspective view showing the appearance of a nullification device included in a first embodiment.
Figure 2:
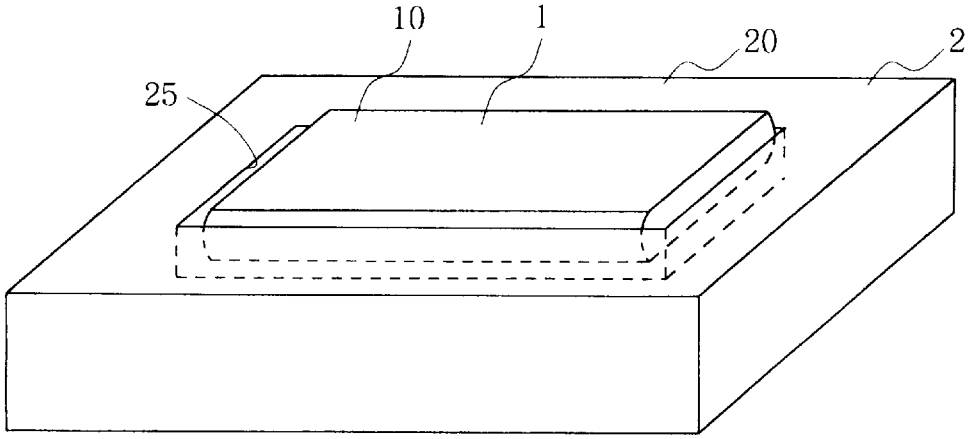
FIG. 2 is a perspective view of the device as placed in a recess of an activation device.

The nullification device 1 of the present embodiment is held in the hand of the clerk, and comprises a circuit board 11 housed in a casing 10 as shown in FIGS. 1 and 2. The device 1 is settable in an operative mode or in an inoperative mode. The device 1 sends out the nullifying signal at all times when in the operative mode while ceasing the transmission of the nullifying signal to the outside when in the inoperative mode.

On the other hand, an activation device 2 is accommodated, for example, in a safe within the store, and comprises a circuit board 21 housed in a casing 20. Formed in the upper side of the casing 20 is a recess 25 for placing therein the casing 10 of the nullification device 1.

Figure 3:
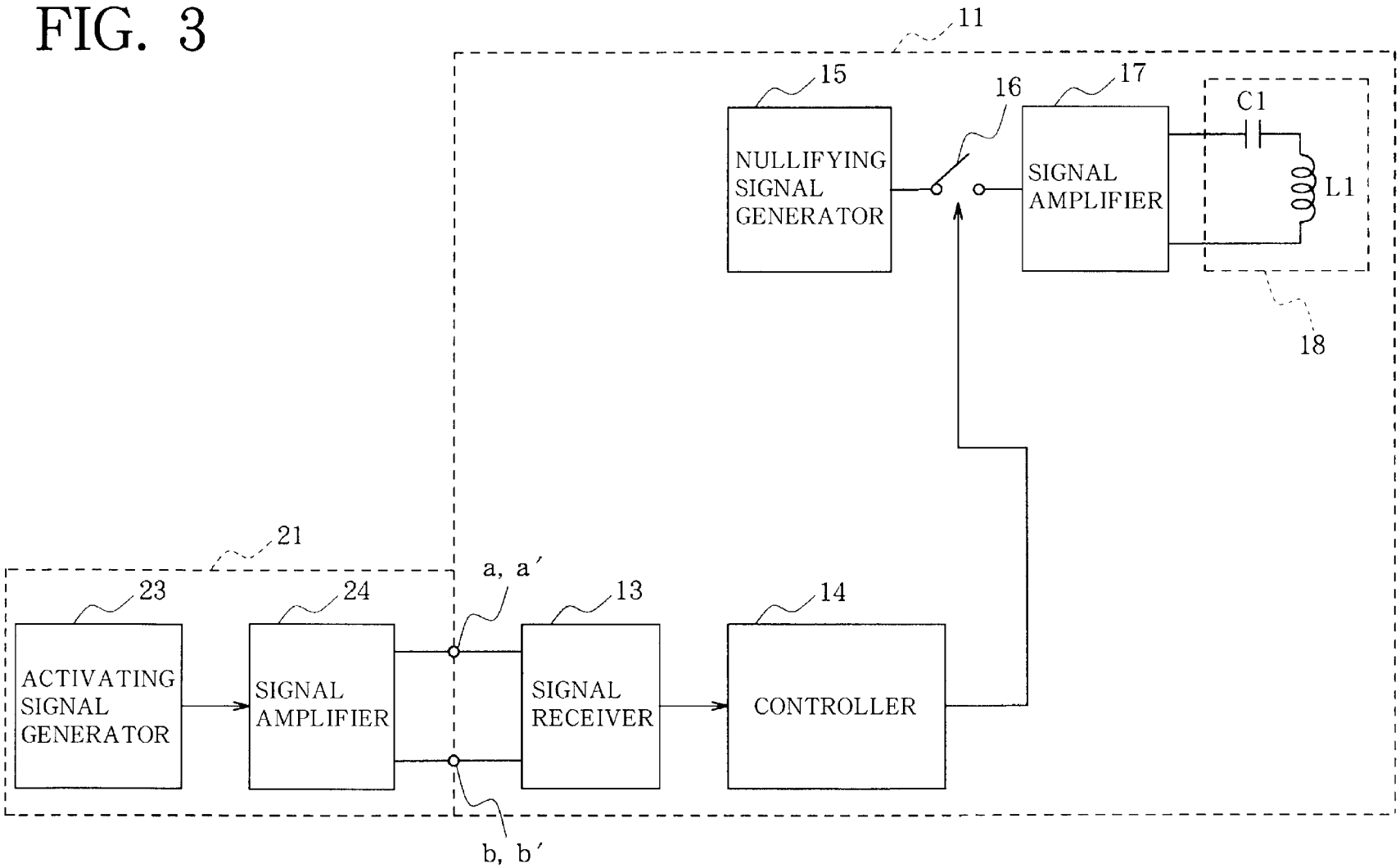
FIG. 3 is a block diagram showing the constructions of circuit boards incorporated respectively in the activation device and the nullification device of the first embodiment.

FIG. 3 shows the constructions of the circuit boards 11, 21 incorporated in the nullification device 1 and the activation device 2, respectively.

The circuit board 11 of the nullification device 1 has a pair of positive and negative connection terminals a and b, which are connected to a controller 14 via a signal receiver 13. The circuit board 11 further comprises a nullifying signal generator 15, which is connected via a mode change switch 16 to a signal amplifier 17. The amplifier 17 is connected to a transmitting antenna 18 comprising a capacitor C1 and a coil L1 which are connected together in series.

The circuit board 21 of the activation device 2 has a pair of positive and negative connection terminals a', b', which are connected to an activating signal generator 23 by way of a signal amplifier 24.

Figure 4:
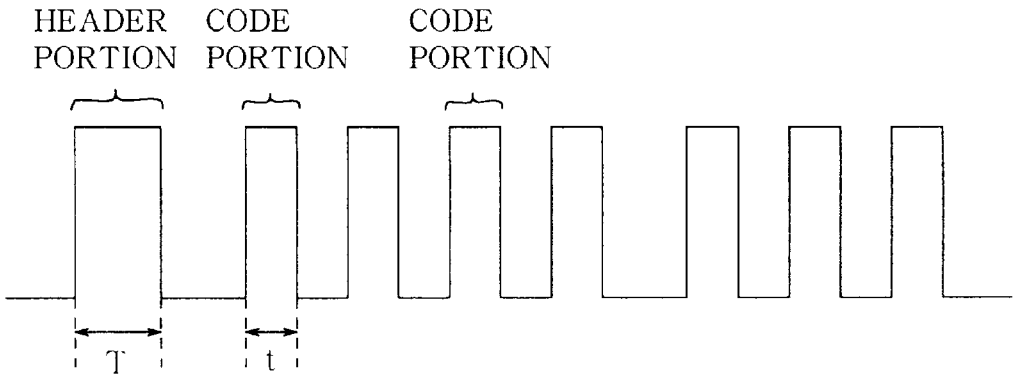
FIG. 4 is a waveform diagram showing an activating signal for use in the first embodiment.

When the nullification device 1 is accommodated in the recess 25 of the activation device 2 as seen in FIG. 2, the terminals a, b of the device 1 are connected to the respective terminals a', b' of the activation device 2 as shown in FIG. 3, and the activating signal produced by the generator 23 of the device 2 is fed to the signal amplifier 24, amplified and thereafter input to the signal receiver 13 by way of the terminals a', b' of the activation device and the terminals a, b of the nullification device. With reference to FIG. 4, the activating signal comprises a plurality of pulses having a definite peak value, and has a header portion having a long on period T and cord portions each having a short on period t.

The signal input to the signal receiver 13 of FIG. 3 is fed to the controller 14, which checks whether the signal is an activating signal. When the signal given by the receiver 13 is the activating signal, the controller 14 receiving the header portion subsequently starts to read code data from the code portions, recognizing the input of the activating signal by reference to the code data.

The controller 14 also measures time. Based on the time measurement and the check result, the controller 14 prepares a switching signal for turning on or off the mode change switch 16 and feeds the signal to the switch 16, whereby the switch 16 is on/off-controlled.

When the mode change switch 16 is turned on, the nullifying signal produced by the nullifying signal generator 15 is input to the amplifier 17 via the switch 16, amplified and sent to the antenna 18, from which the signal is sent out as converted to electromagnetic waves. In this way, the nullification device 1 is set in the operative mode.

When the mode change switch 16 is turned off, on the other hand, the application of the nullifying signal to the amplifier 17 by the generator 15 is ceased. Thus, the nullification device 1 is set in the inoperative mode.

Figure 5:
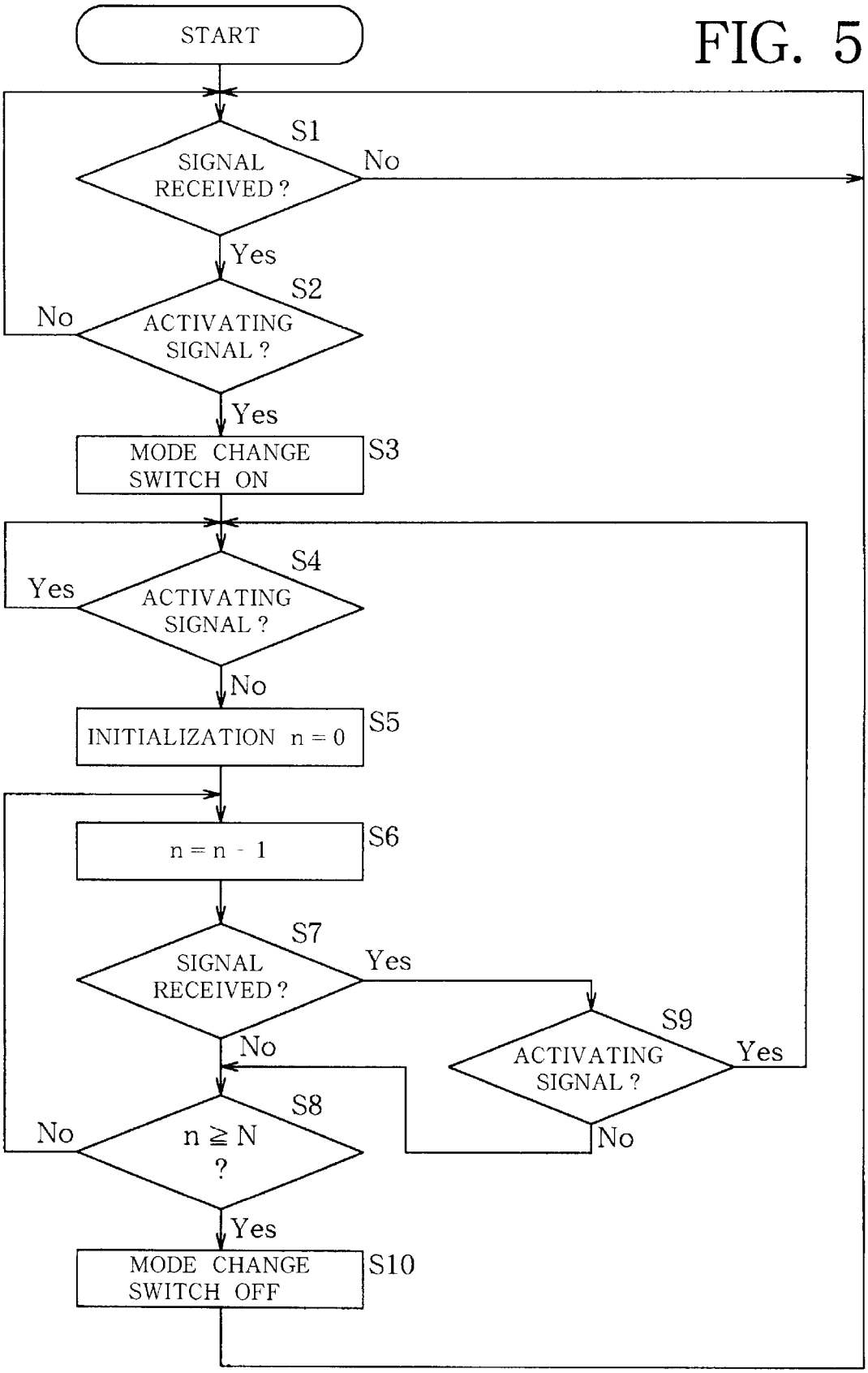
FIG. 5 is a flow chart showing the control procedure to be performed by a controller included in the nullification device.

FIG. 5 shows the control procedure to be performed by the controller 14.

First, the controller inquires whether some signal is received from the receiver 13 in step S1. If the answer is negative, step S1 is repeated for inquiry.

If the inquiry of step S1 is answered in the affirmative, on the other hand, step S2 follows to inquire whether the signal from the receiver 13 is an activating signal from the activation device 2. When the nullification device 1 is placed in the recess 25 of the activation device 1, the answer is affirmative, and the sequence proceeds to step S3, in which the mode change switch 16 is turned on. Consequently, the device 1 is set in the operative mode. If the answer to the inquiry of step S2 is negative, on the other hand, the sequence returns to step S1.

An inquiry is subsequently made in step S4 as to whether the activating signal is continuously received. When the nullification device 1 is removed from the recess 25 of the activation device 2, the answer is negative, followed by step S5. If the answer is affirmative, step S4 is repeated for inquiry.

A counter variable n is initialized in step S5, and the counter variable n is counted up subsequently in step S6. An inquiry is then made in step S7 as to whether some signal is received from the receiver 13. If the answer is negative, the sequence proceeds to step S8.

When the inquiry of step S7 is answered in the affirmative, step S9 follows, in which an inquiry is made as to whether the signal from the receiver 13 is the activating signal from the activation device 2. When the device 1 is in the recess 25 of the device 2, the answer is affirmative, followed by step S4 again. If the answer to the inquiry of step S9 is negative, step S8 follows.

Step S8 inquires whether the counter variable n is at least a predetermined value N ($N \geqq 1$). The predetermined value N is so determined that the lapse of time until the variable n as initialized to zero in step S5 increases to N is, for example, 8 hours. When the answer to the inquiry of step S8 is affirmative, step S10 follows to turn off the mode change switch 16, whereupon the sequence returns to step S1. Consequently, the nullification device 1 is set in the inoperative mode. On the other hand, when the inquiry of step S8 is answered in the negative, step S6 follows.

With the antitheft system described, the clerk places the nullification device 1 into the recess 25 of the activation device 2 when closing the store. When the device 1 is placed into the recess 25 of the device 2, the inquiry of step S2 is answered in the affirmative, and the switch 16 is turned on in step S3, whereby the nullification device 1 is set in the operative mode to send out the nullifying signal at all times.

When opening the store, the clerk takes out the device 1 from the recess 25 of the activation device 2 within the safe and holds the device 1 in his hand. When the nullification device 1 is thus taken out of the recess 25 of the activation device 2, the inquiry of step S4 is answered in the negative, and the sequence proceeds to step S5, in which time measurement is started.

When rightfully selling a commodity to the customer, the clerk transmits a nullifying signal to the alarm unit 3 from the nullification device 1 in his hand to bring the unit 3 in the reset state in which the buzzer 31 of the unit gives off no alarm, whereupon the clerk removes the alarm unit 3 from the commodity and hands the commodity to the customer.

Upon lapse of 8 hours after the store opening time, the inquiry of step S8 is answered in the affirmative, followed by step S10 to turn off the mode change switch 16, whereby the nullification device 1 is set in the inoperative mode, ceasing sending out the nullifying signal.

The clerk thereafter returns the nullification device 1 to the recess 25 of the activation device 2 when closing the store, whereupon the inquiry of step S2 is answered in the affirmative. The device 1 is set in the operative mode again to send out a nullifying signal at all times.

If the clerk returns the nullification device 1 to the recess 25 of the activation device 2 before the lapse of 8 hours from the store opening time, the inquiry of step S9 is answered in the affirmative, followed by step S4. When the clerk thereafter takes out the nullification device 1 from the recess 25 of the activation device 2 again, the inquiry of step S4 is answered in the negative, whereupon the current time count is canceled to start time measurement from that time on.

Upon lapse of 8 hours after the nullification device 1 has been taken out of the recess 25 of the activation device 2, the device 1 is set in the inoperative mode, ceasing transmitting the nullifying signal to the outside as described above. Accordingly, should a customer or clerk temporarily employed steal the device 1 from the store, the thief is unable to use the device 1 in other store if 8 hours has elapsed after the removal of the device 1 from the recess 25 of the device 2, whereby wrongful use of the device 1 can be precluded.

If the nullification device of the present embodiment is temporarily placed in the recess 25 of the activation device 2 and then taken out therefrom again, the time for transmitting the nullifying signal to the outside is extended, so that the embodiment is useful in the case where the service time is lengthened beyond the usual store closing time.

Second Embodiment

Figure 6:
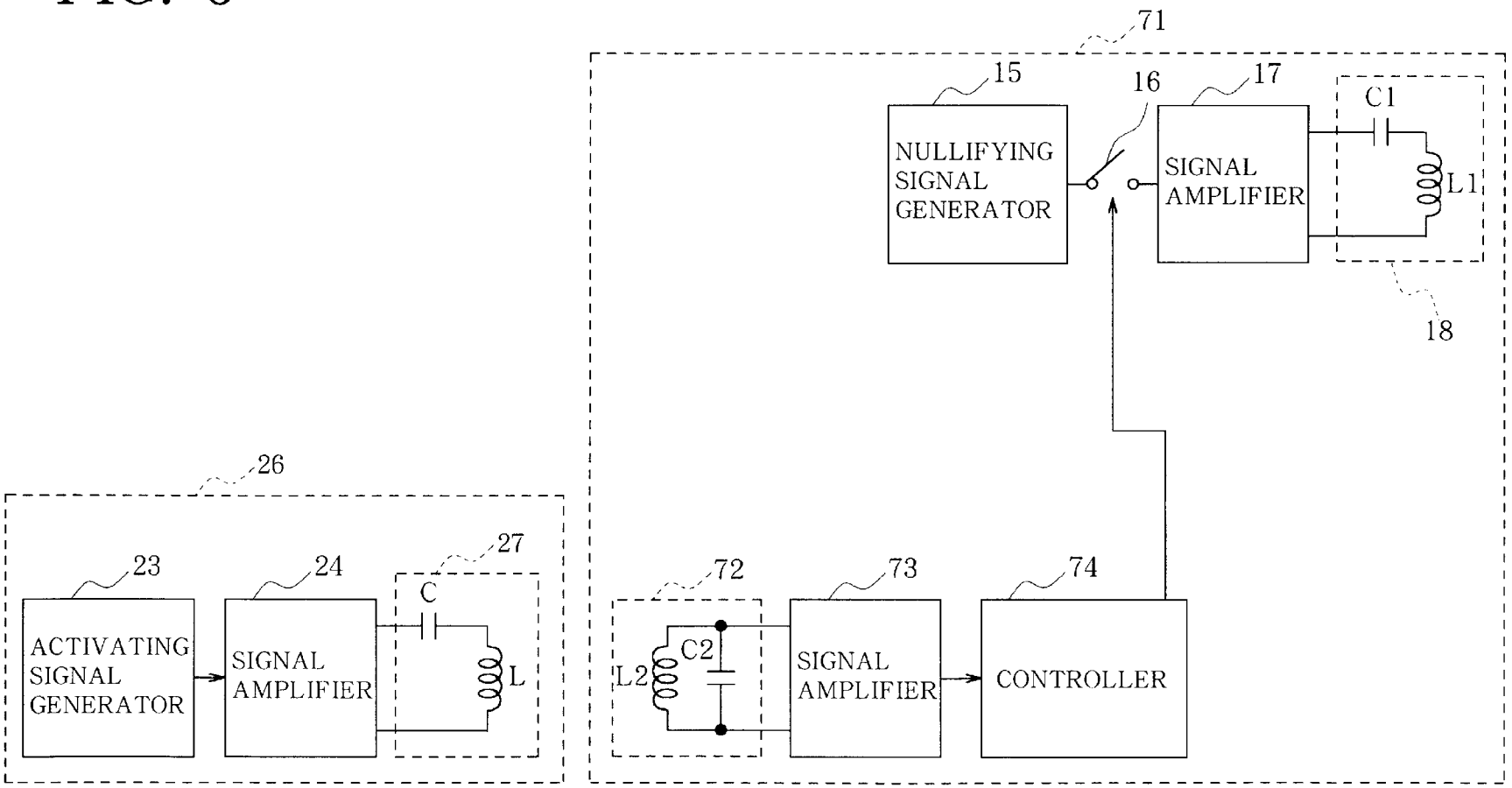
FIG. 6 is a block diagram showing the constructions of circuit boards incorporated in respective activation device and nullification device of a second embodiment.

FIG. 6 shows the constructions of circuit boards 71, 26 incorporated respectively in a nullification device 1 and an activation device 2 included this embodiment.

The circuit board 71 of the present nullification device has the same construction as the circuit board 11 of the first embodiment shown in FIG. 3 with the exception of a receiving antenna 72, signal amplifier 73 and controller 74. The receiving antenna 72 comprises a capacitor C2 and a coil L2 which are connected together in parallel, and is connected to the controller 74 via the amplifier 73.

On the other hand, the circuit board 26 of the activation device has the same construction as the circuit board 21 of the first embodiment shown in FIG. 3 with the exception of a transmitting antenna 27 as shown in FIG. 6. The transmitting antenna 27 comprises a capacitor C and a coil L which are connected in series, and is connected to a signal amplifier 24.

When the nullification device 1 of the present embodiment is placed into the recess 25 of the activation device 2 as shown in FIG. 2, the receiving antenna 72 of the device 1 is positioned in proximity with the transmitting antenna 27 of the activation device 2 as seen in FIG. 6.

In this state, an activation signal generator 23 of the activation device produces a high-frequency current as an original activating signal. The current is amplified by the signal amplifier 24 and then fed to the coil L of the transmitting antenna 27. This causes the coil L of the antenna 27 to generate lines of magnetic force, which penetrate through the coil L2 of the receiving antenna 72 of the nullification device, consequently coupling the coil L of the transmitting antenna 27 and the coil L2 of the receiving antenna 72 electromagnetically to each other.

Figure 7:
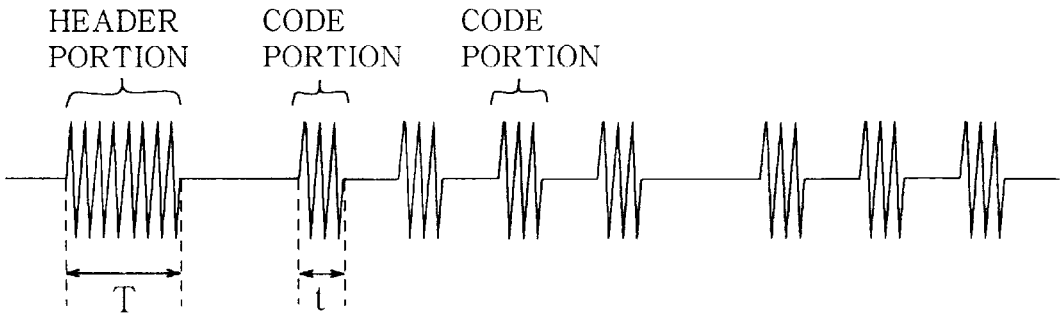
FIG. 7 is a waveform diagram showing an activating signal for use in the second embodiment.

As a result, the coil L2 of the receiving antenna 72 of the nullification device produces a high-frequency current as shown in FIG. 7. The current comprises burst waves of predetermined pattern, and has a header portion of long on period T and code portions having a short on period t.

With reference to FIG. 6, the high-frequency current thus obtained is fed as an activating signal to the signal amplifier 73, amplified and thereafter input to the controller 74.

The controller 74 checks whether the signal input from the amplifier 73 is an activating signal. When the input signal is the activating signal, the controller 74 starts to read code data from the cord portions shown FIG. 7 subsequent to the receipt of the header portion and recognizes the input of the activating signal by reference to the code data.

Based on the result of time measurement and the result of checking, the controller 74 prepares a switching signal for turning on or off a mode change switch 16 and feeds the signal to the switch 16, whereby the switch 16 is on/off-controlled.

When the nullification device 1 of the present embodiment is placed into the recess 25 of the activation device 2 as shown in FIG. 2 as is the case with the first embodiment, the device 1 is set in an operative mode to transmit a nullifying signal to the outside. Upon lapse of a predetermined period of time, e.g., 8 hours, after the device 1 has been taken out of the recess 25 of the device 2, the device 1 is set in an inoperative mode to cease sending out the nullifying signal.

Third Embodiment

Figure 8:
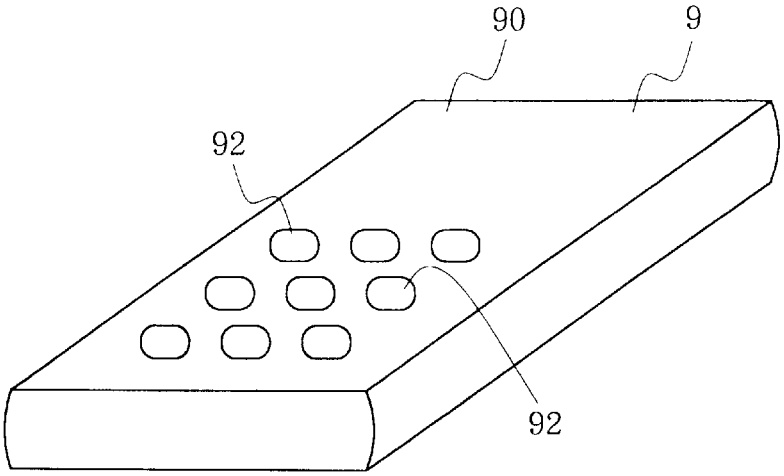
FIG. 8 is a perspective view showing the appearance of a nullification device included in a third embodiment.

The embodiment comprises a nullification device 9, which is to be held in the hand of the clerk. The device 9 comprises a plurality of manual keys 92 arranged on the surface of a casing 90 as seen in FIG. 8. Code data can be input by the manual keys 92. The casing 90 has a circuit board (not shown) housed therein. As in the first embodiment, the nullification device 9 transmits a nullifying signal to the outside at all times in an operative mode, while ceasing transmitting the nullifying signal in an inoperative mode.

Figure 9:
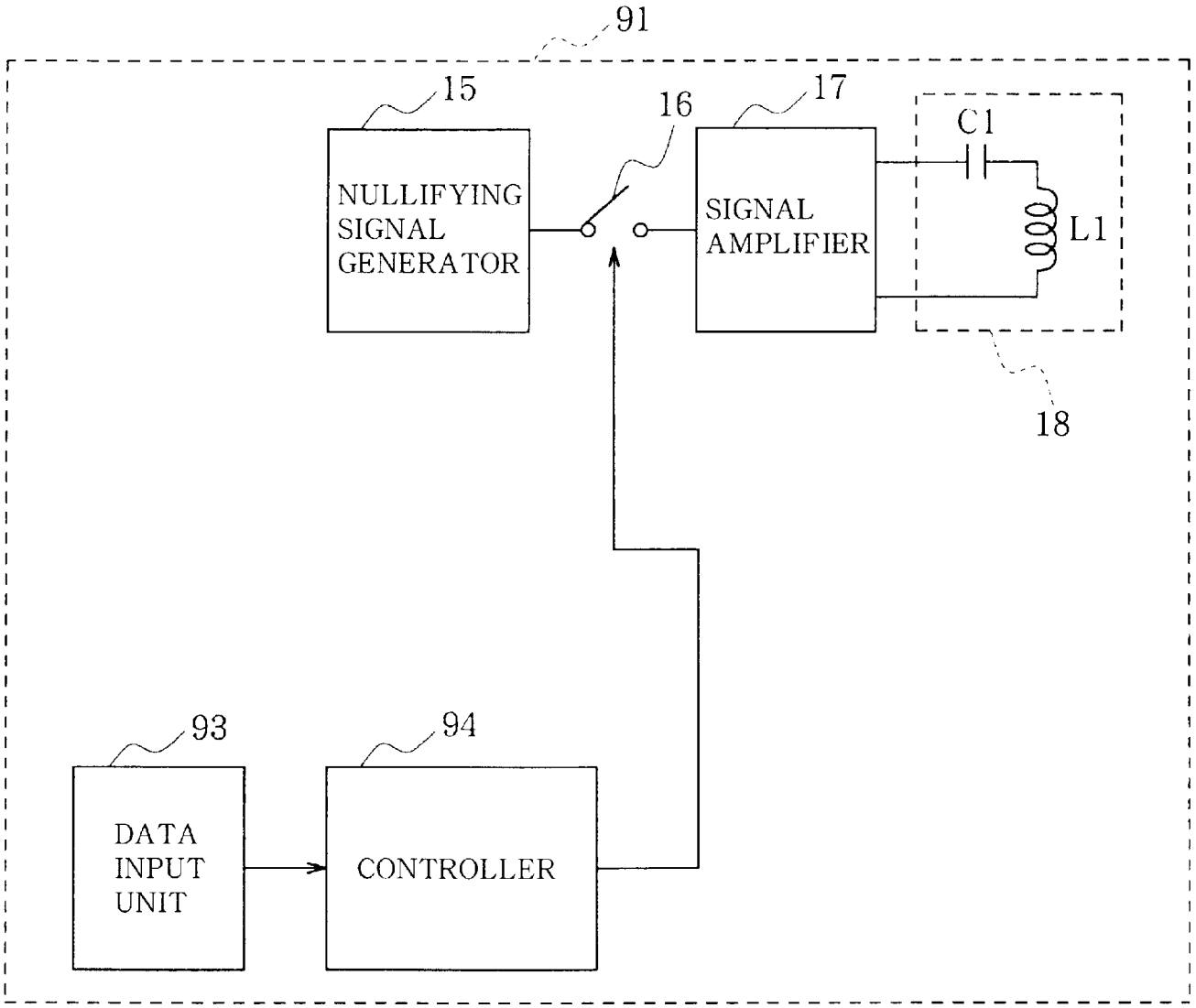
FIG. 9 is a block diagram showing the construction of a circuit board incorporated in the nullification device.

FIG. 9 shows the construction of the circuit board 91 incorporated in the nullification device 9. With the exception of a data input unit 93 and controller 94, the circuit board 91 has the same construction as the circuit board 11 of the nullification device 1 of the first embodiment shown in FIG. 3.

When some of the manual keys 92 are manipulated, code data corresponding to the key manipulation is input to the data input unit 93 and then fed to the controller 94.

The controller 94 has registered therein specified on code data and off code data comprising three digits. The controller 94 checks whether the code data input from the input unit 93 matches the on code data and further whether the data input matches the off code data.

Based on the result of time measurement and the result of checking, the controller 94 prepares a switching signal for turning on or off a mode change switch 16 and feeds the signal to the switch 16, whereby the switch 16 is on/off-controlled.

Figure 10:
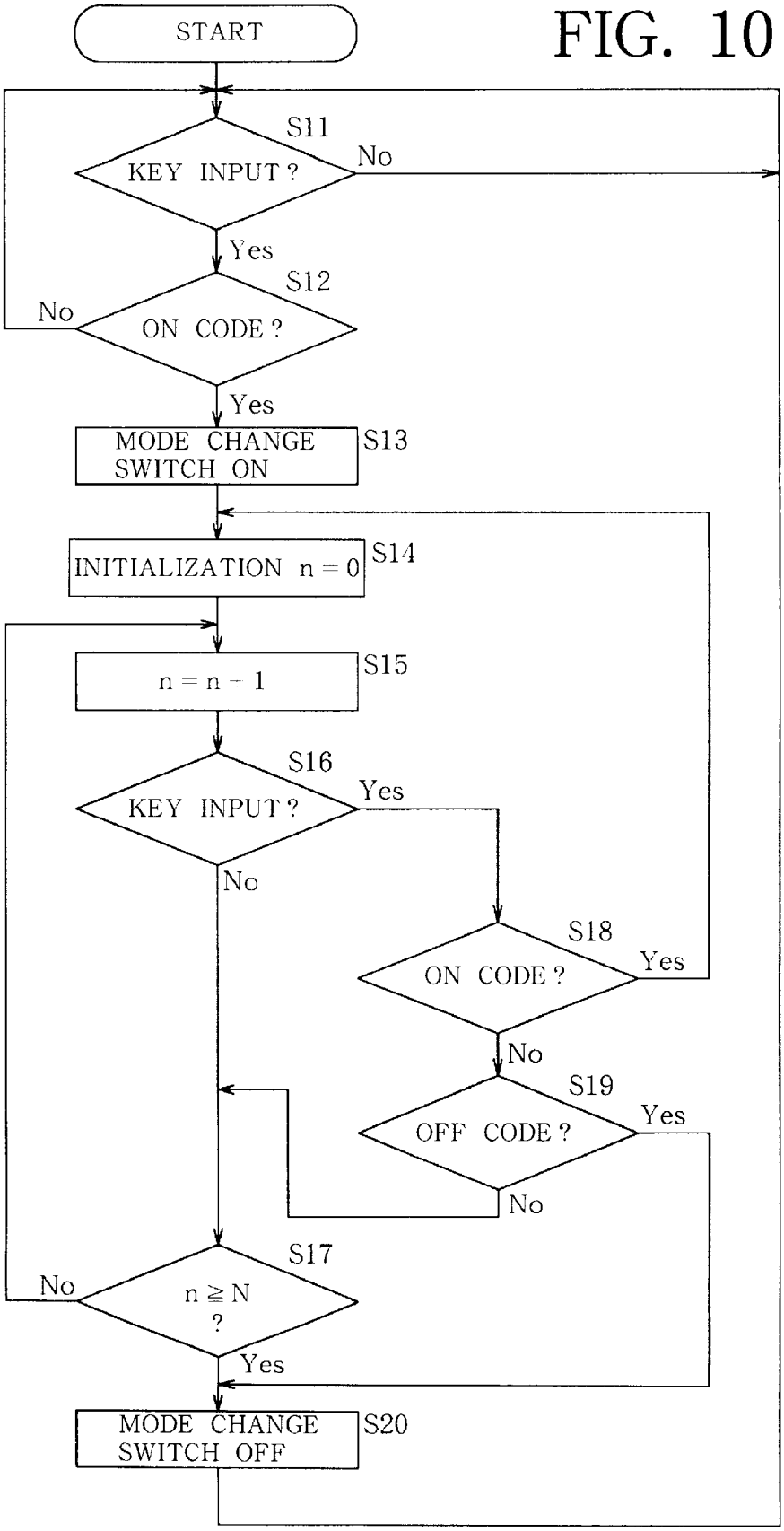
FIG. 10 is a flow chart showing the control procedure to be performed by a controller included in the nullification device.

FIG. 10 shows the control procedure to be performed by the controller 94.

An inquiry is first made in step S11 as to whether some code data has been received from the data input unit 93. If the answer is negative, step S11 is repeated for inquiry.

On the other hand, when the inquiry of step S11 is answered in the affirmative, step S12 follows to inquire whether the code data from the input unit 93 is in match with the on code data. When the answer to the inquiry is negative, the sequence returns to step S11.

When the answer to the inquiry of step S12 is affirmative, step S13 follows to turn on the mode change switch 16. Consequently, the nullification device 9 is set in the operative mode.

A counter variable n is initialized in step S14, and the counter variable n is thereafter counted up in step S15. An inquiry is then made in step S16 as to whether some code data has been received from the data input unit 93. If the answer is negative, the sequence proceeds to step S17.

When the inquiry of step S16 is answered in the affirmative, on the other hand, step S18 follows, in which an inquiry is made as to whether the code data from the input unit 93 is in match with the on code. When the answer is affirmative, the sequence returns to step S14. If the answer to the inquiry of step S18 is negative, step S19 follows to inquire whether the code data from the input unit 93 is in match with the off code. When the answer is negative, step S17 follows, whereas if the answer is affirmative, step S20 follows.

Step S17 inquires whether the counter variable n is at least a predetermined value N ($N \geqq 1$). The predetermined value N is so determined that the lapse of time until the variable n as initialized to zero in step S14 increases to N is, for example, 8 hours. When the answer to the inquiry of step S17 is negative, the sequence returns to step S15, whereas if the answer is affirmative, step S20 follows.

The mode change switch 16 is turned off in step S20, and the sequence thereafter returns to step S11. Consequently, the nullification device 9 is set in the inoperative mode.

With the antitheft system described, the clerk inputs the same code data as the on code data when opening the store by manipulating some of the manual keys 92. When the data is input, the inquiry of step S12 is answered in the affirmative, and the mode change switch 16 is turned on in step S13, whereby the nullification device 1 is set in the operative mode to send out the nullifying signal at all times. Time measurement is also started.

When rightfully selling a commodity to the customer, the clerk causes the nullification device 9 in his hand to transmit a nullifying signal to the alarm unit 3 to bring the unit in the reset state in which the buzzer 31 of the unit gives off no alarm, whereupon the clerk removes the alarm unit 3 from the commodity and hands the commodity to the customer.

Upon lapse of 8 hours after the store opening time, the inquiry of step S17 is answered in the affirmative, followed by step S20 to turn off the mode change switch 16, whereby the nullification device 9 is set in the inoperative mode, ceasing sending out the nullifying signal.

If the clerk manipulates manual keys 92 to enter the same code data as the on code data before the lapse of 8 hours from the store opening time, the inquiry of step S18 is answered in the affirmative, followed by step S14 again, in which the current time count is canceled to start time measurement from that time on.

Alternatively if the clerk manipulates manual keys 92 to enter the same code data as the off code data before the lapse of 8 hours from the store opening time, the inquiry of step S19 is answered in the affirmative, followed by step S20 to turn off the mode change switch 16, whereby the nullification device 9 is set in the inoperative mode, ceasing the transmission of the nullifying signal to the outside.

The nullification device of the present embodiment is set in the inoperative mode by entering the same code data as the off code data by manual keys 92 regardless of the on code data entering time, consequently ceasing the transmission of the nullifying signal to the outside, so that the present embodiment is useful in the case where the service time is shortened from 8 hours by closing the store earlier.

Fourth Embodiment

Like the first embodiment, the antitheft system of this embodiment comprises an activation device 2 and a nullification device. The activation device 2 has the same construction as that of the first embodiment shown in FIGS. 1 and 3 and therefore will not be described repeatedly.

Figure 11:
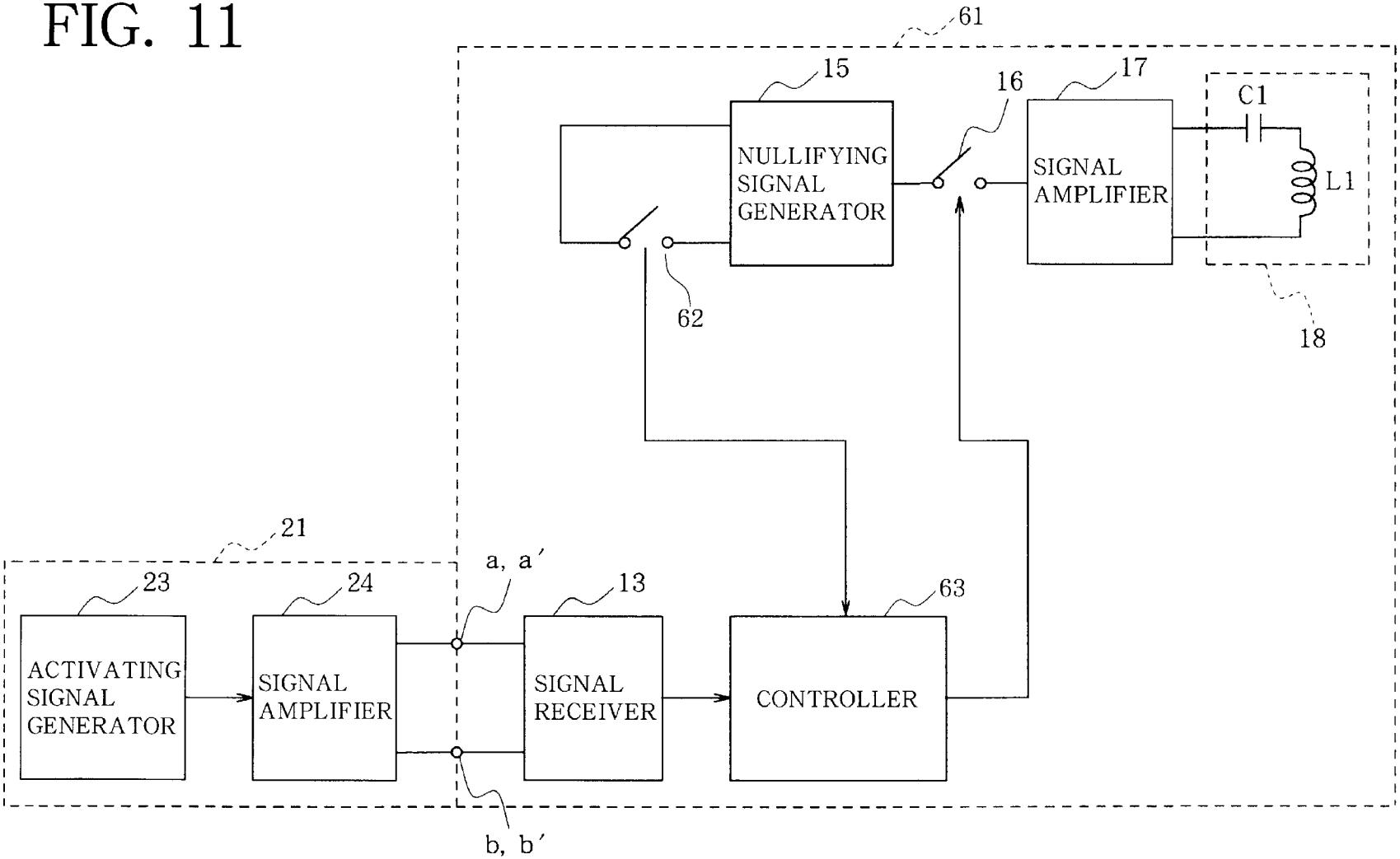
FIG. 11 is a block diagram showing the constructions of circuit boards incorporated in respective activation device and nullification device of a fourth embodiment.

With reference to FIG. 11, the nullification device of the present embodiment comprises a signal output switch 62 which is to be manipulated in resetting an alarm unit 3 by sending a nullifying signal to the unit 3. The nullification device is settable in an operative mode or in an inoperative mode. The switch 62 is turned on in the operative mode to transmit the nullifying signal to the outside, whereas the switch 62 is off in the inoperative state, whereby the device is forced to stop transmitting the nullifying signal to the outside.

The present nullification device has the same construction as that of the first embodiment shown in FIGS. 1 and 3 with the exception of the signal output switch 62 and a controller 63 which differs from that of the first embodiment in function.

With reference to FIG. 11, the controller 63 of the present embodiment counts up the number of times the switch 62 is turned on. Based on the resulting count and the result of an inquiry as to whether the signal input from a signal receiver 13 is an activating signal, the controller prepares a switching signal for turning a mode change switch 16 on or off and feeds the signal to the switch 16.

When the signal output switch 62 is turned on by the user, with the mode change switch 16 on, the nullifying signal emitted by a nullifying signal generator 15 is fed to a signal amplifier 17 by way of the mode change switch 16, amplified, then fed to a transmitting antenna 18 and sent out as converted to electromagnetic waves. In this way, the nullification device is set in the operative mode.

With the mode change switch 16 off, on the other hand, the feed of nullifying signal from the signal generator 15 to the amplifier 17 is suspended despite the state of the signal output switch 62. In this way, the nullification device is set in the inoperative mode.

Figure 12:
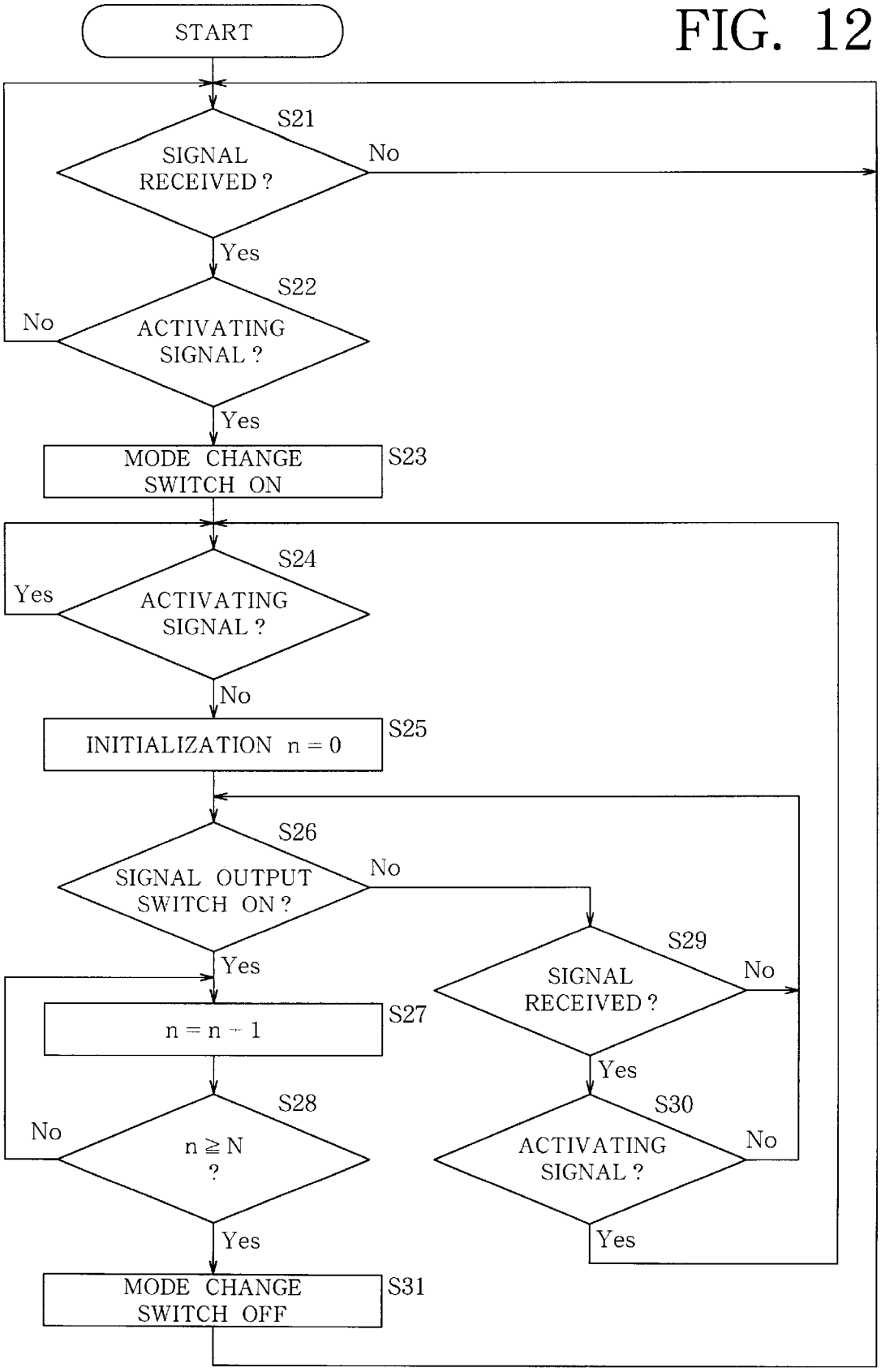
FIG. 12 is a flow chart showing the control procedure to be performed by a controller included in the nullification device.

FIG. 12 shows the control procedure to be executed by the controller 63.

First, the controller inquires whether some signal is received from the receiver 13 in step S21. If the answer is negative, step S21 is repeated for inquiry.

If the inquiry of step S21 is answered in the affirmative, on the other hand, step S22 follows to inquire whether the signal from the receiver 13 is an activating signal from the activation device 2. When the answer is affirmative, the sequence proceeds to step S23, in which the mode change switch 16 is turned on. Consequently, the nullification device is set in the operative mode. If the answer to the inquiry of step S22 is negative, on the other hand, the sequence returns to step S21.

An inquiry is subsequently made in step S24 as to whether the activating signal is continuously received. When the answer is affirmative, step S24 is repeated for inquiry.

If the inquiry of step S24 is answered in the negative, step S25 follows to initialize a counter variable n. Step S26 thereafter inquires whether the signal output switch 62 is on. When the clerk turns on the signal output switch 62 to reset the alarm unit 3 by sending a nullifying signal from the nullification device to the alarm unit 3, the answer is affirmative, followed by step S27 to count up the counter variable n. An inquiry is subsequently made in step S28 as to whether the counter variable n is at least a predetermined value N ($N \geqq 1$). The predetermined value N is determined according to the frequency of use of the nullification device. For example in stores wherein the device is used about 25 times a day, the value N is slightly greater than 25, e.g., 30. When the inquiry of step S28 is answered in the affirmative, step S31 follows to turn off the mode change switch 16. The sequence thereafter returns to step S21. Consequently, the nullification device is set in the inoperative mode. If the answer to the inquiry of step S28 is negative, step S27 follows again.

In the case where the inquiry of step S26 is answered in the negative, step S29 follows to inquire whether some signal has been received from the signal receiver 13. When the answer is negative, the sequence returns to step S26, whereas if the answer is affirmative, step S30 follows to inquire whether the signal from the receiver 13 is the activating signal from the activation device 2. If the inquiry is answered in the negative in step S30, step S26 follows again, whereas if the answer is affirmative, the sequence returns to step S24.

With the antitheft system described, the clerk places the nullification device into the recess 25 of the activation device 2 when closing the store. When the nullification device is placed into the recess 25 of the device 2, the inquiry of step S22 is answered in the affirmative, and the mode change switch 16 is turned on in step S23, whereby the nullification device is set in the operative mode, and made ready to send out the nullifying signal by turning on the signal output switch 62.

When opening the store, the clerk takes out the nullification device from the recess 25 of the activation device 2 and holds the device 1 in his hand. When the nullification device is thus taken out of the recess 25 of the activation device 2, the inquiry of step S24 is answered in the negative, and the sequence proceeds to step S25 to count up the number of times the signal output switch 62 is turned on by the clerk from that time on.

When rightfully selling a commodity to the customer, the clerk turns on the signal output switch 62 of the nullification device in his hand to transmit a nullifying signal to the alarm unit 3 from this device, resets the unit 3, then removes the alarm unit 3 from the commodity and hands the commodity to the customer. In this way, the number of times the nullification device is used by the clerk by turning on the switch 62 is counted up. Upon this frequency reaching 30, the inquiry of step S28 is answered in the affirmative, followed by step S31 to turn off the mode change switch 16, whereby the nullification device is set in the inoperative mode and forced to cease transmitting the nullifying signal to the outside despite the state of the signal output switch 62.

If the clerk returns the nullification device to the recess 25 of the activation device 2 before the nullification device is used at least 30 times, the inquiry of step S30 is answered in the affirmative, followed by step S24. When the clerk thereafter takes out the nullification device from the recess 25 of the activation device 2 again, the inquiry of step S24 is answered in the negative, whereupon the current count indicating the number of times the clerk has turned on the signal output switch 62 is canceled to start to count up the frequency from that time on.

The nullification device of the present embodiment is set in the inoperative mode and forced to cease sending out the nullifying signal despite the state of the signal output switch 62, when used 30 times as taken out from the recess 25 of the activation device 2. Accordingly, even if a customer or clerk temporarily employed should steal the nullification device from the store, the device fails to transmit the nullifying signal to the outside and becomes unusable despite the closing of the switch 62 after the device is used 30 times as removed from the recess 25 of the activation device 2.

When the nullification device of the present embodiment is returned to the recess 25 of the activation device 2 once and then taken out from the recess 25 again, the nullification device becomes usable an increased number of times, so that the device is advantageous to use in selling increased quantities of commodities to a greater number of customers.

Fifth Embodiment

This embodiment includes a nullification device which comprises a controller different from that of the fourth embodiment in function and which has the same construction as that of the fourth embodiment shown in FIG. 11 with the exception of the controller. The device will not be described repeatedly, therefore.

Figure 13:
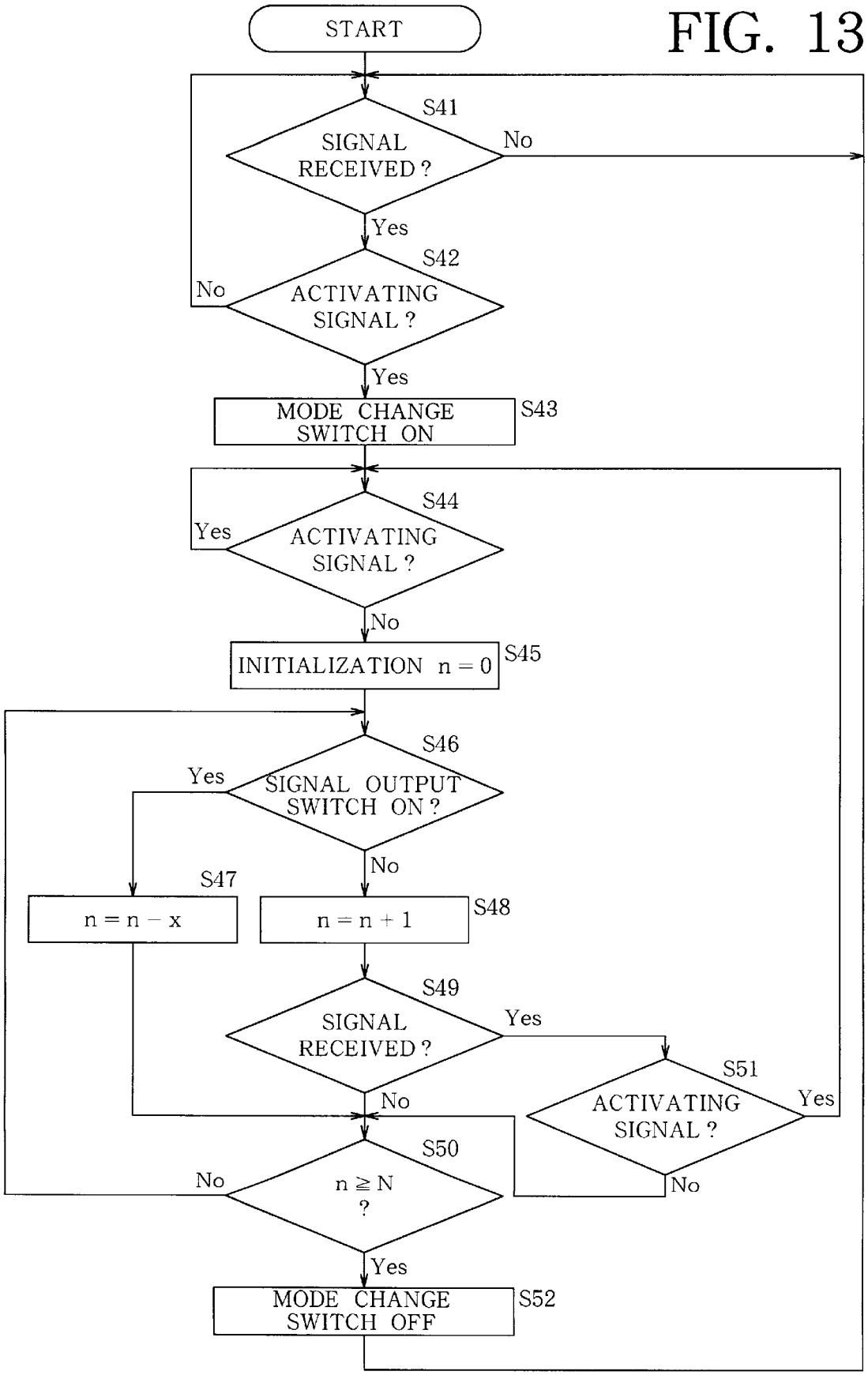
FIG. 13 is a flow chart showing the control procedure to be performed by a controller of nullification device of a fifth embodiment.

FIG. 13 shows the control procedure to be executed by the controller of the present embodiment.

First, the controller inquires whether some signal is received from a signal receiver 13 in step S41. If the answer is negative, step S41 is repeated for inquiry.

If the inquiry of step S41 is answered in the affirmative, on the other hand, step S42 follows to inquire whether the signal from the receiver 13 is an activating signal from an activation device 2. When the answer is affirmative, the sequence proceeds to step S43, in which a mode change switch 16 is turned on. Consequently, the nullification device is set in the operative mode. If the answer to the inquiry of step S42 is negative, on the other hand, the sequence returns to step S41.

An inquiry is subsequently made in step S44 as to whether the activating signal is continuously received. When the answer is affirmative, step S44 is repeated for inquiry, whereas if the answer is negative, step S45 follows to initialize a counter variable n. The steps so far described are exactly the same as in the foregoing fourth embodiment.

An inquiry is subsequently made in step S46 as to whether a signal output switch 62 is on. When the answer is affirmative, step S47 follows to count up the counter variable n by x. The sequence then proceeds to step S50. The value x is, for example, 10 in the case where a nullifying signal is sent out from the nullification device for 10 sec by turning on the signal output switch 62 once.

On the other hand, if the inquiry of step S46 is answered in the negative, step S48 follows to increment the counter variable n by 1. The sequence thereafter proceeds to step S49 to inquire whether some signal has been received from the signal receiver 13. When the answer is negative, step S50 follows.

If the inquiry of step S49 is answered in the affirmative, step S51 follows to inquire whether the signal from the receiver 13 is the activating signal from the activation device 2. When answered in the affirmative, the inquiry is followed by step S44 again, whereas if the answer is negative, the sequence proceeds to step S50.

An inquiry is made in step S50 as to whether the counter variable n is at least a predetermined value N ($N \geqq 1$). When the answer is negative, the sequence returns to step S46. If the inquiry of step S50 is answered in the negative and further if the inquiry of step S46 is answered in he negative, followed by repetition of steps S46 to S50, the variable n is counted up at an interval of 1 sec in step S48, and the predetermined value N in step S50 is set at a value in conformity with the frequency of use of the nullification device and with the service time of the store from opening time until the closing time.

When the inquiry of step S50 is answered in the affirmative, step S52 follows to turn off the mode change switch 16, whereupon the sequence returns to step S41. Consequently, the nullification device is set in the inoperative mode.

The more frequently the nullification device of this embodiment is used, the shorter is the time during which the device is usable.

The embodiments described above are intended to illustrate the present invention and should not be construed as restricting the invention defined in the appended claims or reducing the scope thereof. Further the devices of the invention are not limited to those of the foregoing embodiments in construction but can of course be modified variously without departing from the spirit of the invention as set forth in the claims.

Figure 14:
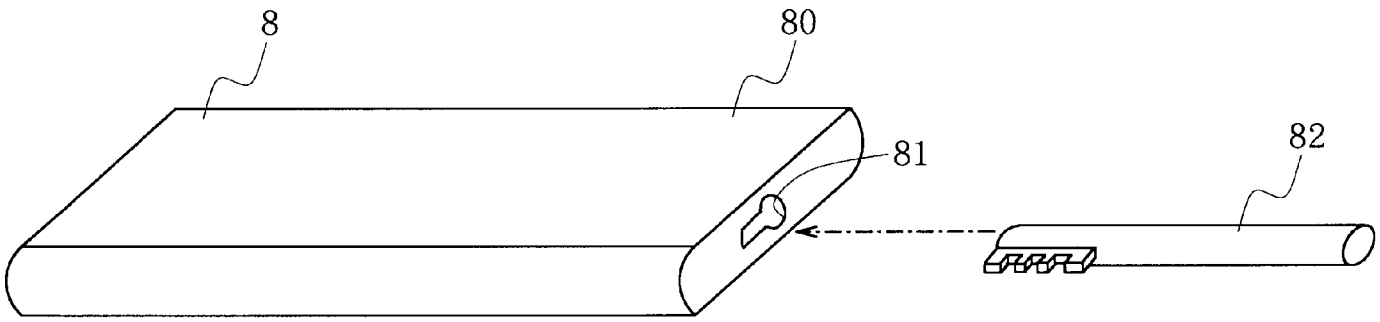
FIG. 14 is a perspective view showing the appearance of a nullification device included in another embodiment.

For example, the embodiments described are so adapted that the mode change switch 16 is turned on when the nullification device is placed into the recess 25 of the activation device 2 or when the same code data as the on code data is input by manipulating manual keys 92, whereas FIG. 14 shows an alternative nullification device 8 having a casing 80 which is formed with a keyhole 81, such that when the clerk performs an on-manipulation with a specified key 82 engaged in the keyhole 81, the mode change switch 16 can be turned on.

What is claimed is:

1. An antitheft system comprising an alarm unit to be connected to an article to be prevented from being stolen, and a nullification device for transmitting a nullifying signal to the alarm unit, the alarm unit comprising alarm means for producing an alarm, detecting means for detecting disconnection of the alarm unit from the article to produce a detection signal, and alarm control means for operating the alarm means upon receiving the detection signal and nullifying the detection signal after receiving the nullifying signal from the nullification device, the nullification device comprising:

means for generating the nullifying signal at all times in an operative mode or generating the nullifying signal in response to the user's manipulation, activation commanding means for giving an activation command in response to the user's manipulation, means for producing a variable increasing with lapse of time or with the frequency of the user's manipulation for generating the nullifying signal, means for resetting the variable producing means in response to the user's manipulation, and nullification control means for setting the nullifying signal generating means in the operative mode in response to the activation command while setting the nullifying signal generating means in an inoperative mode upon the variable produced by the variable producing means exceeding a predetermined threshold value.

2. An antitheft system according to claim 1 which further comprises an activation device for transmitting an activating signal to the nullification device, the activation device comprising means for preparing the activating signal, and means for transmitting to the nullification device the activating signal produced by the activating signal preparing means, the nullification device comprising receiving means capable of receiving the activating signal from the transmitting means of the activation device in response to a manipulation by the user, the activation commanding means being operable to give the activation command in response to the activating signal received from the receiving means, the resetting means being operable to reset the variable producing means when the activating signal is no longer received by the receiving means.

3. An antitheft system according to claim 2 wherein the activation device and the nullification device are housed in separate casings respectively, the casing of the activation device being formed with a recessed portion for placing therein the casing of the nullification device, and the transmitting means of the activation device and the receiving means of the nullification device are opposed to each other for the receiving means to receive the activating signal from the transmitting means, with the casing of the nullification device placed in the recessed portion of the casing of the activation device.

4. An antitheft system according to claim 3 wherein each of the transmitting means of the activation device and the receiving means of the nullification device comprises a plurality of terminals to be in contact respectively with those of the other.

5. An antitheft system according to claim 3 wherein the transmitting means of the activation device and the receiving means of the nullification device respectively comprise a transmitter and a receiver for a magnetic signal or optical signal.

6. An antitheft system according to claim 1 wherein the nullification device comprises a data input means, and the activation commanding means of the nullification device gives the activation command while the resetting means resets the variable producing means when start data representing a specified code is input by the data input means.

7. An antitheft system according to claim 6 wherein the nullification device comprises stop commanding means for giving a stopping command when a stop data representing a specified code is input by the data input means, and the nullification control means sets the nullifying signal generating means in the inoperative mode in response to the stopping command.

8. An antitheft system according to claim 6 wherein the data input means comprises a key input device.

9. An antitheft system according to claim 1 wherein the nullification device comprises key means, and the activation commanding means of the nullification device gives the activation command while the resetting means resets the variable producing means in response to an on manipulation with use of the key means.

* * * * *

UNITED STATES PATENT AND TRADEMARK OFFICE

CERTIFICATE OF CORRECTION

PATENT NO. : 5,982,283

DATED : November 9, 1999

INVENTOR(S) : Matsudaira et al.

It is certified that error appears in the above-identified patent and that said Letters Patent is hereby corrected as shown below:

Title page,

Item [73], please delete "Sanyo Electronics Components Co., Ltd." and insert therefor, -- Sanyo Electronic Components Co., Ltd. --

Signed and Sealed this

Twenty-fifth Day of July, 2000

*Attest:*

*Attesting Officer*

Q. TODD DICKINSON

*Director of Patents and Trademarks*